US008752521B2

(12) United States Patent
Braig et al.

(10) Patent No.: US 8,752,521 B2
(45) Date of Patent: Jun. 17, 2014

(54) PISTON

(75) Inventors: Ralf Braig, Schorndorf (DE); Rainer Fischer, Stuttgart (DE); Thomas Hettich, Schwieberdingen (DE); Peter Kleinle, Freiberg am Neckar (DE); Michael Marquardt, Welzheim (DE)

(73) Assignee: Mahle International GmbH (DE)

( * ) Notice: Subject to any disclaimer, the term of this patent is extended or adjusted under 35 U.S.C. 154(b) by 17 days.

(21) Appl. No.: 13/221,498

(22) Filed: Aug. 30, 2011

(65) Prior Publication Data

US 2013/0036997 A1 Feb. 14, 2013

(30) Foreign Application Priority Data

Aug. 11, 2011 (DE) ..... 10 2011 080 822

(51) Int. Cl.
*F02F 3/00* (2006.01)

(52) U.S. Cl.
USPC ..... 123/193.6

(58) Field of Classification Search
USPC ..... 92/208, 209, 233, 238, 239; 123/193.6
See application file for complete search history.

(56) References Cited

U.S. PATENT DOCUMENTS

| | | | | |
|---|---|---|---|---|
| 4,730,549 | A * | 3/1988 | Pfeiffenberger | 92/239 |
| 5,000,078 | A | 3/1991 | Gabele | |
| 5,076,225 | A | 12/1991 | Tokoro et al. | |
| 5,299,490 | A * | 4/1994 | Harrer et al. | 92/208 |
| 5,562,074 | A | 10/1996 | Koch | |
| 6,073,602 | A * | 6/2000 | Muta | 123/193.6 |
| 6,467,396 | B1 * | 10/2002 | Issler | 92/186 |
| 6,860,190 | B2 | 3/2005 | Oversby et al. | |
| 2008/0264376 | A1 | 10/2008 | Braig et al. | |
| 2011/0174153 | A1 | 7/2011 | Hettich et al. | |

FOREIGN PATENT DOCUMENTS

| | | | |
|---|---|---|---|
| DE | 4109160 | A1 | 9/1992 |
| DE | 4434994 | A1 | 4/1996 |
| DE | 10145589 | A1 | 4/2003 |
| DE | 102007020447 | A1 | 10/2008 |
| DE | 102009032379 | A1 | 2/2010 |
| EP | 0385390 | A1 | 9/1990 |
| FR | 2182572 | A5 | 12/1973 |
| GB | 1142349 | A | 2/1969 |
| JP | 64-025446 | U | 2/1989 |
| JP | 03-117656 | U | 5/1991 |
| JP | 2003-083159 | A | 3/2003 |
| JP | 2010-150994 | A | 7/2010 |
| WO | WO-2008131739 | A1 | 11/2008 |
| WO | WO-2009/006650 | A1 | 1/2009 |
| WO | WO-2009068494 | A2 | 6/2009 |
| WO | WO-2010017808 | A2 | 2/2010 |

OTHER PUBLICATIONS

English abstract for DE-10145589.
German Search Report for DE-102011080822.1 dated May 21, 2012. (8 pages).
English abstract for JP-2003-083159.
English abstract for JP-3117656.
English abstract for JP-2010150994.

* cited by examiner

*Primary Examiner* — M. McMahon
(74) *Attorney, Agent, or Firm* — Rader, Fishman & Grauer PLLC

(57) ABSTRACT

A piston for an internal combustion engine may include a piston head and a piston shaft. The piston shaft may have two shaft walls, one arranged on a pressure side and the other arranged on a counter-pressure side. Two box walls may have pin bosses and connect the shaft walls. Each of the box walls may have a first partial wall section and a second partial wall section. The first partial wall section may extend between the pin boss and the shaft wall arranged on the pressure side. The second partial wall section may extend between the pin boss and the shaft wall arranged on the counter-pressure side. A first longitudinal center line of the first partial wall section is may be convergent to a second longitudinal center line of the second partial wall section, wherein the first and second longitudinal center lines—intersect each other outside the piston.

18 Claims, 3 Drawing Sheets

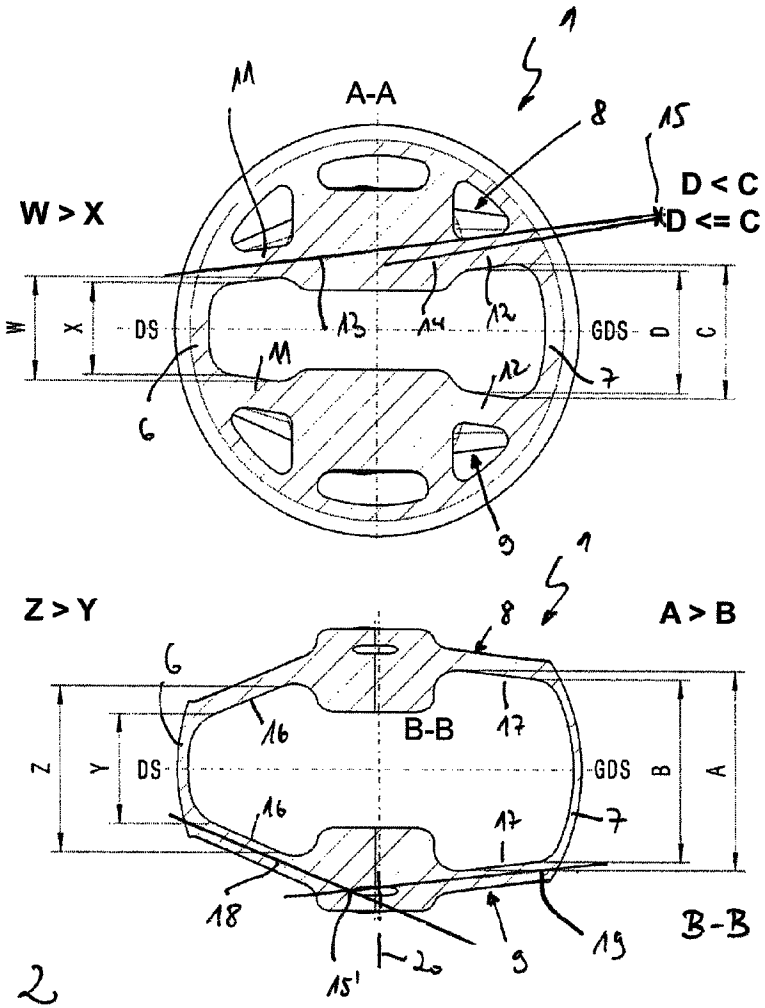
Fig. 2
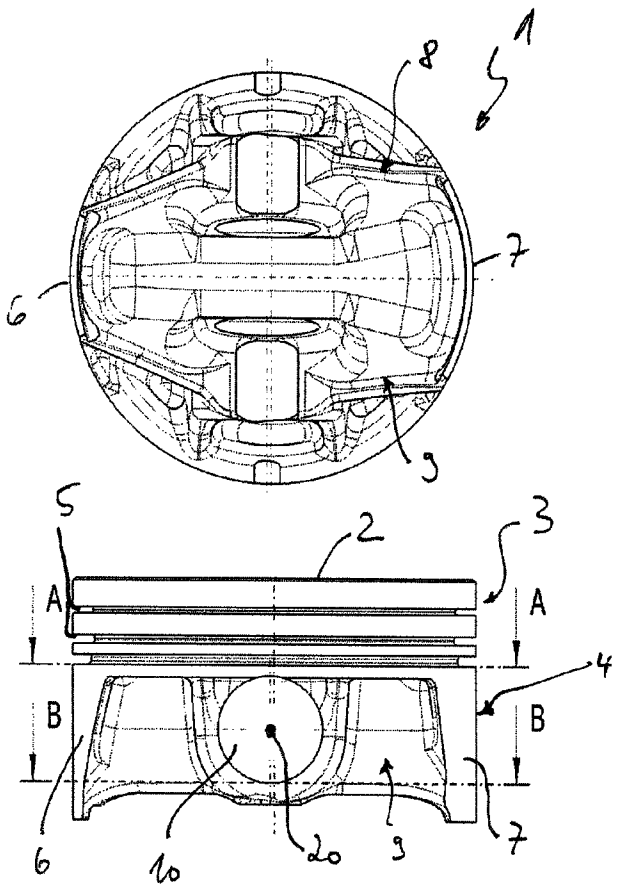

PISTON

CROSS-REFERENCES TO RELATED APPLICATION

This application claims priority to German patent application DE 102011080822.1 filed on Aug. 11, 2011, which is hereby incorporated by reference in its entirety.

TECHNICAL FIELD

The present invention relates to a piston for an internal combustion engine with a piston head and a piston shaft adjoining thereon in accordance with the introductory clause of claim 1.

BACKGROUND

From DE 10 2009 032 379 A1 a generic piston is known for an internal combustion engine with a piston head, a top land with a circumferential ring part and with a piston shaft, which has two shaft walls arranged on the pressure side and the counter-pressure side, and two box walls connecting these shaft walls. The shaft wall arranged on the pressure side is shorter here, viewed in the peripheral direction of the piston, than the shaft wall arranged on the counter-pressure side. To reduce the stressing of the piston, the box walls on the pressure side run in a straight line and obliquely, wherein the distance of the box walls in the region of the pin bosses is greater than in the region of the shaft wall on the pressure side.

From DE 10 2007 020 447 A1 a further generic piston for an internal combustion engine is known, in which the shaft wall arranged on the pressure side is shorter in peripheral direction of the piston than the shaft wall arranged on the counter-pressure side. Hereby, the effect is to arise that cracks scarcely still occur in the region of the pin bosses or respectively in the region of the support of the box walls on the underside of the piston head.

From DE 101 45 589 B4 a further piston is known for an internal combustion engine with a piston head and a piston shaft adjoining thereon, wherein the piston shaft consists of bearing shaft walls and box walls lying back, which connect the shaft walls with each other, and pin bosses set back in the direction of a pin axis to a piston axis, which penetrate the connecting walls. The connecting walls are constructed here in the region of their circumferential lower edge so as to be convex to one axis, and in the region of their upper edge beneath an annular area so as to be concave to the axis, wherein the width of the shaft walls at the lower edge corresponds approximately to the width of the shaft walls beneath the annular area. Hereby, in particular, a guidance of the piston inside the cylinder is to be improved.

SUMMARY

A further piston is known from DE 41 09 160 C2

Generally, the trend in current engine development is towards a $CO_2$ reduction, which is implemented by a form of so-called "downsizing". In order to be able to reduce the oscillating mass of pistons in internal combustion engines, in addition pistons of lightweight construction are being increasingly used which, moreover, can bear higher thermo-mechanical stresses. In pistons of lightweight construction, the main objective lies in embodying the construction so as to be optimized with regard to stress, in order to prevent crack formations at highly stressed sites, for example on the piston head or the highly stressed box walls on the pressure side, and at the same time to meet the requirements for a distinct weight reduction and thereby a reduction of the $CO_2$ emissions. At the same time, such pistons of lightweight construction are to have further functional characteristics, such as for example anti-seizing property, low shaft friction and a high degree of quiet running.

The present invention deals with the problem of indicating for a piston of the generic type an improved embodiment which is distinguished in particular by a reduced weight and an increased load-bearing capacity.

This problem is solved according to the invention by the subject matter of the independent claim 1. Advantageous embodiments are the subject matter of the dependent claims.

The present invention is based on the general idea of aligning or respectively arranging individual partial wall sections of box walls in pistons for the internal combustion engine in a structurally different manner and thereby of reducing the stressing of a piston head and of a box wall on the counter-pressure side. The piston according to the invention has a piston head and a piston shaft adjoining thereon directly or indirectly via an annular area, which piston shaft has two shaft walls arranged on the pressure side and the counter-pressure side and two box walls connecting these shaft walls. In the box walls, in turn, pin bosses are arranged. In the region between the pin boss and the piston head, each box wall has two partial wall sections, the first partial wall section of which extends between the pin boss and the shaft wall on the pressure side, and the second partial wall section of which extends between the pin boss and the shaft wall on the counter-pressure side. A longitudinal centre line of the first partial wall section is arranged here in accordance with the invention so as to be staggered with respect to a longitudinal centre line of the second partial wall section of the same box wall, wherein the two longitudinal centre lines of the two partial wall sections belonging to a box wall intersect each other outside the piston. Hereby, on the one hand, an increase in strength can be achieved and, at the same time on the other hand the elasticity can be retained with respect to the connection of the box wall to the associated shaft wall. This promotes not only the loading capacity of the piston according to the invention, but in addition important characteristics such as for example anti-seizing property, low piston friction and a high degree of quiet running. At the same time, this structural configuration makes possible a comparatively low weight and hence a small oscillating mass of the piston in operation, which has a positive effect on the $CO_2$ emissions of the internal combustion engine. Depending on the individual arrangement or respectively alignment of the individual partial wall sections of the box walls, in addition to an increase in stability, realized for example by first partial wall sections running towards each other in the direction of the shaft wall on the pressure side, an improved and advantageous arrangement of an injection nozzle can also be achieved, which can be achieved in particular by first partial wall sections running away from each other respectively in the direction of the shaft wall on the pressure side. Through the first partial wall sections running away from each other, more space is available for the positioning of the injection nozzle, whereby the latter can be arranged more flexibly. The advantages with regard to stability and arrangement of the injection nozzles can also be transferred here to the pressure side by a corresponding alignment of the second partial wall sections in the direction of the shaft wall on the counter-pressure side.

In an advantageous further development of the solution according to the invention, each box wall has in the region beneath the pin boss, i.e. in a region facing away from the piston head, a third and a fourth partial wall section, of which the third partial wall section runs between the pin boss and the shaft wall on the pressure side, and the fourth partial wall section runs between the pin boss and the shaft wall on the counter-pressure side. A longitudinal centre line of this third partial wall section intersects here a longitudinal centre line of the fourth partial wall section inside the piston, so that the third and fourth partial wall sections are preferably arranged so as to be convex with respect to an orthogonal to the axis of the pin boss. Hereby, for example, also in the region beneath the pin boss, i.e. on a side of the piston shaft facing away from the piston head, via the alignment or respectively orientation of the individual partial wall sections of the box walls a direct influence can be made on the stability and the weight and the possible positioning of the injection nozzle. If, for example, the stability is to be increased on the counter-pressure side, in this case the respectively fourth partial wall sections of the two box walls beneath the pin boss would have to run towards each other in the direction of the shaft wall on the counter-pressure side. In an improved arrangement possibility for the injection nozzle, on the other hand, the two fourth partial wall sections of the two box walls would have to run away from each other in the direction of the shaft wall on the counter-pressure side. The same applies in an analogous form, of course, for the pressure side.

Further important features and advantages of the invention will emerge from the sub-claims, from the drawings and from the associated description of the figures with the aid of the drawings.

It shall be understood that the features which are mentioned above and which are to be explained further below are able to be used not only in the respectively indicated combination, but also in other combinations or in isolation, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWING

Herein there are shown, diagrammatically respectively

DETAILED DESCRIPTION

Figure 1:
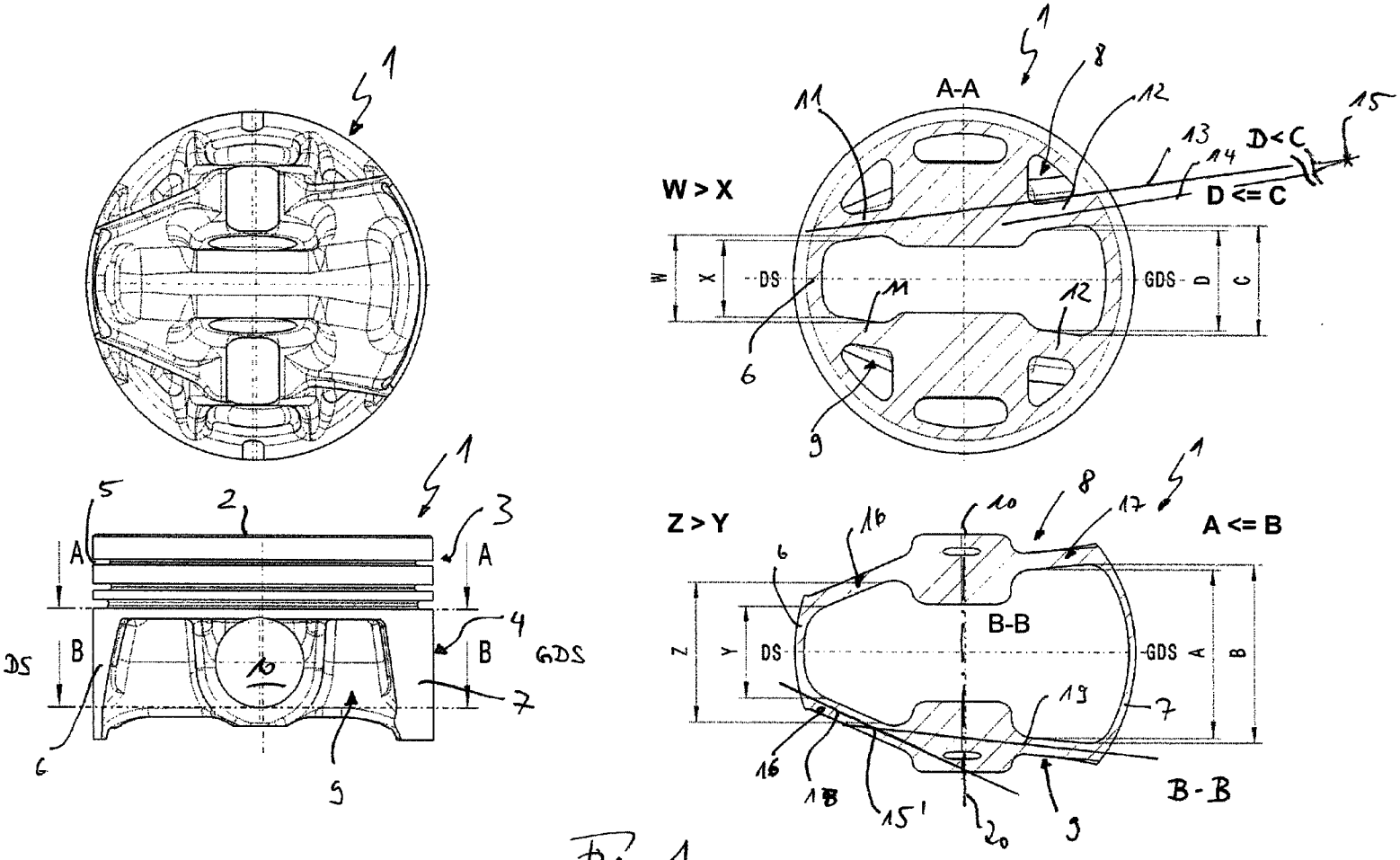
FIG. 1 a piston according to the invention in different views and sectional representations, FIG. 2 a representation as in FIG. 1, but with differently aligned partial wall sections of the individual box walls, FIG. 3 further views and sectional representation of a further possible embodiment of the piston according to the invention with, in turn, differently oriented partial wall sections of the individual box walls.
Figure 3:
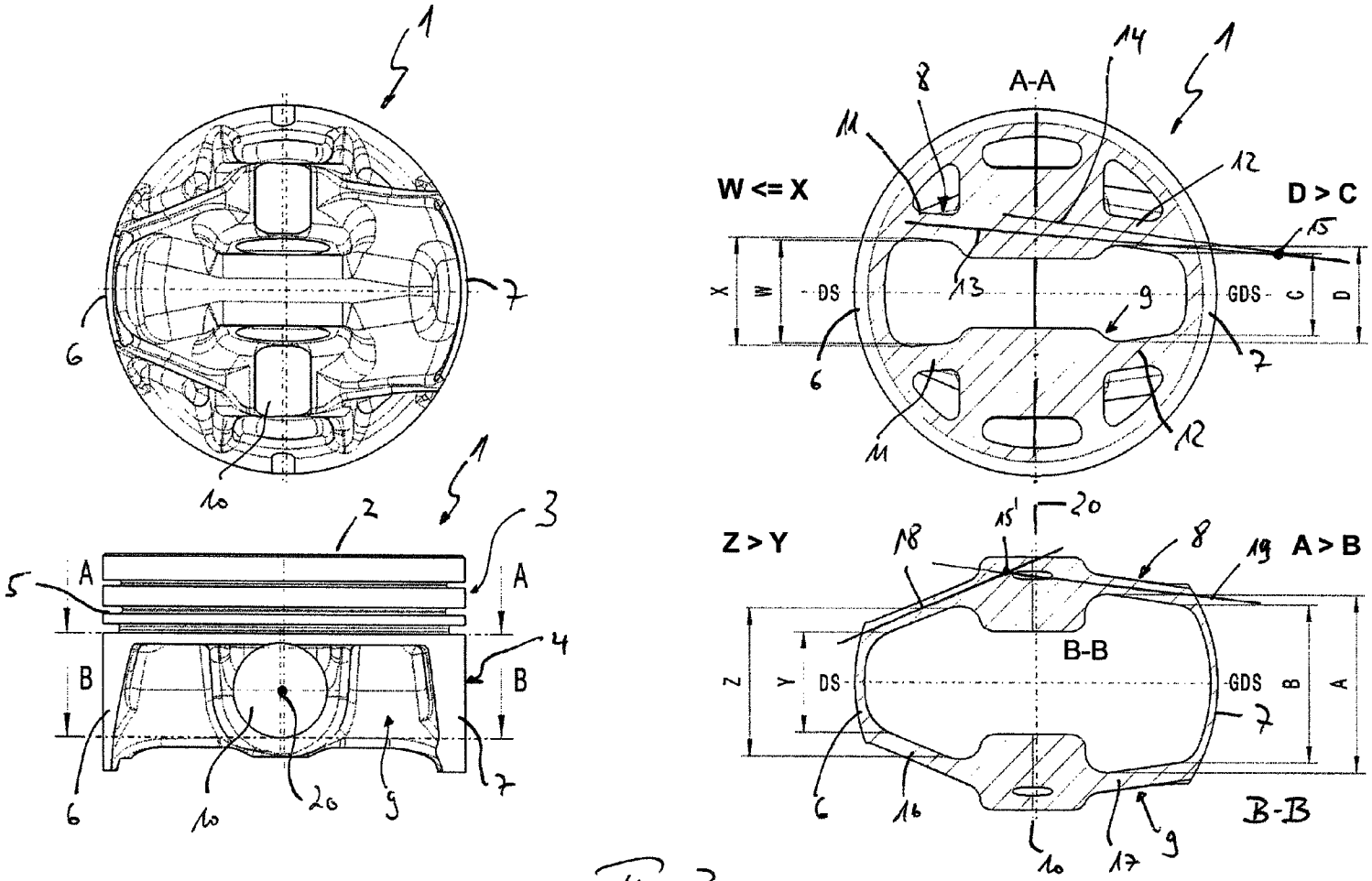

In accordance with FIGS. 1 to 3, a piston 1 according to the invention for an internal combustion engine has a piston head 2 and a piston shaft 4 adjoining thereon via an annular area 3. Different annular grooves 5, for example to receive piston rings, are provided in the annular area 3. The piston shaft 4 has two shaft walls 6 and 7 arranged on the pressure side DS and the counter-pressure side GDS, which walls are connected with each other via two box walls 8 and 9 (cf. in particular the sectional representations). Pin bosses 10 or respectively at least bores for such pin bosses 10 are arranged in the box walls 8 and 9. According to the invention, each box wall 8, 9 now has two partial wall sections 11, 12 in the region between the pin boss 10 and the piston head 2, of which the first partial wall section 11 runs between the pin boss 10 and the shaft wall 6 on the pressure side, and the second partial wall section 12 runs between the pin boss 10 and the shaft wall 7 on the counter-pressure side. A longitudinal centre line 13 of the first partial wall section 11 is arranged here so as to be staggered with respect to a longitudinal centre line 14 of the second partial wall section 12, wherein the two longitudinal centre lines 13, 14 intersect each other outside the piston 1 in an intersection point 15. In all the pistons 1 which are shown, furthermore, the shaft wall 6 arranged on the pressure side DS is shorter in the peripheral direction of the piston 1 than the shaft wall 7 arranged on the counter-pressure side GDS, as can be clearly seen in particular in the respective sectional representations B-B.

In a region beneath the pin boss 10, each box wall 8, 9 has a third and a fourth partial wall section 16, 17, of which the third partial wall section 16 runs between the pin boss 10 and the shaft wall 6 on the pressure side, and the fourth partial wall section 17 runs between the pin boss 10 and the shaft wall 7 on the counter-pressure side. A longitudinal centre line 18 of the third partial wall section 16 intersects here a longitudinal centre line 19 of the fourth partial wall section 17 inside the piston 1 in an intersection point 15'. The third and fourth partial wall sections 16, 17 are arranged so as to be convex with respect to an orthogonal to the axis 20 of the pin boss 10. Generally, the first and second partial wall sections 11, 12 have a greater wall thickness than the third and fourth partial wall sections 16, 17 of the respective box walls 8, 9. In addition, a distance of the two box walls 8, 9 between the pin boss 10 and the piston head 2 is smaller than a distance of the box walls 8, 9 beneath the pin boss 10.

The individual possible embodiments and the advantages which are able to be achieved therewith are now to be explained more precisely below.

In the piston 1 illustrated in FIG. 1, the respectively first partial wall sections 11 of the two box walls 8, 9 run towards each other in the direction of the shaft wall 6 on the pressure side (cf. sectional representation A-A). The inclination of the two longitudinal centre axes 13, 14 of the two partial wall sections 11, 12 is comparatively small here, so that the intersection point 15 is only drawn for the sake of clarity, but would not have had space on the drawing without an interruption for distance.

The running towards each other of the two first partial wall sections 11 of the two box walls 8, 9 in the direction of the shaft wall 6 is represented by the relationship of the two reference values W>X. Accordingly, the running away from each other by the second partial wall sections 12 of the two box walls 8, 9 in the direction of the shaft wall 7 on the counter-pressure side is described by the relationship of the two reference values D<C. The running away from each other by the two second partial wall sections 12 not only makes possible a reduction to the weight, but also at the same time a more flexible arrangement of an injection nozzle, which is not described in further detail, wherein the two second partial wall sections 12 could of course also be arranged parallel to each other, wherein in this case the relationship D=C would then apply. Through the running towards each other on the pressure side DS by the two first partial wall sections 11 and, connected therewith, the comparatively close arrangement of the two partial wall sections 11, a distinct increase in the stability of the piston 1 can be achieved. The reference values W, A, B, X, Y, Z are understood respectively to mean a distance of the partial wall sections from each other at the boss connection or respectively at the shaft connection.

If one views the sectional representation B-B, it can be seen that the two third partial wall sections 16 of the two box walls 8, 9 run towards each other in the direction of the shaft wall 6 on the pressure side, whereby here also an increase in stability can be achieved. By comparison, the two fourth partial wall sections 17 of the two box walls 8, 9 run away from each other in the direction of the shaft wall 7 on the counter-pressure side, whereby an increased flexibility can be achieved with regard to the arrangement of the injection nozzle. At the same time, the weight can also be reduced in this area.

In the piston 1 represented in accordance with FIG. 2, the two first partial wall sections 11 of the two box walls 8 again run towards each other in the direction of the shaft wall 6 on the pressure side, which is illustrated by the relationship W>X. In an analogous manner to the sectional representation A-A of FIG. 1, the two second partial wall sections 12 of the two box walls 8, 9 run away from each other in the direction of the shaft wall 7 on the counter-pressure side, which is demonstrated by the relationship D<C. Here, also, it is conceivable that the relationship D=C applies, so that the longitudinal centre axis 14 of the second partial wall sections 12 runs orthogonally to the pin axis 20. Through the alignment of the individual partial wall sections 11, 12 of the two box walls 8, 9, selected in the sectional representation A-A of FIG. 2, an increase in stability can be achieved in the region of the pressure side DS, and a reduction in weight and a flexible arrangement of the injection nozzle can be achieved in the region of the counter-pressure side GDS.

In the sectional representation B-B of FIG. 2, the third and fourth partial wall sections 16, 17 of the two box walls 8, 9 are arranged so as to be convex with respect to an orthogonal of the pin axis 20 of the pin boss 10, which is expressed by the relationships Z>Y and A>B. In this case, therefore, an increase in stability is achieved both on the pressure side DS and also on the counter-pressure side GDS, because the third partial wall sections 16 and the fourth partial wall sections 17 run towards the respectively associated shaft wall 6, 7 and are arranged comparatively closely adjacent to each other there. An intersection point of the individual longitudinal centre lines 18, 19 of the respective partial wall sections 16, 17 lies inside the piston 1 here.

The piston 1 according to FIG. 3 is distinguished by two first partial wall sections 11, which run away from each other in the direction of the shaft wall 6 on the pressure side and thereby make possible a weight reduction and a flexible arrangement of the injection nozzle. The running away from each other by the two first partial wall sections 11 in the direction of the shaft wall 6 on the pressure side is expressed by the relationship W<X. Of course, it is also conceivable that the two first partial wall sections 11 of the two box walls 8, 9 run parallel in the direction of the shaft wall 6 on the pressure side, which would then be expressed by the relationship W=X. On the counter-pressure side GDS, on the other hand, the two second partial wall sections 12 run towards each other in the direction of the shaft wall 7 on the counter-pressure side, whereby in this case an increase in stability is able to be achieved. The sectional representation B-B of the piston 1 of FIG. 3 corresponds substantially to the sectional representation B-B of FIG. 2, wherein the two longitudinal centre axes 18, 19 again intersect each other in an intersection point 15', which lies inside the piston 1.

However, all the embodiments have in common the fact that the intersection point 15 of the two longitudinal centre axes 13, 14 of the two partial wall sections 11, 12 lies outside the piston 1.

The partial wall sections 11, 12, arranged staggered with respect to each other, of the two box walls 8, 9 therefore make possible a saving on weight in the relationships D<C and W<X, and an increase in stability in the relationships D>C and W>X. In addition, in the relationships D<C and W<X an increased flexibility can be achieved with regard to the arrangement of the injection nozzle. Of course, it is also generally conceivable that the first and second partial wall sections 11, 12 are arranged so as to be convex with respect to an orthogonal to the axis 20 of the pin boss 10, wherein in this case then with respect to the third and fourth partial wall sections 16, 17 the relationship Z<Y and A<B would apply. This would make possible an increase in the stabilities in the region of the shaft wall 6 on the pressure side and of the associated first partial wall sections 11 and the third partial wall sections 16, and an increase in stability in the region of the shaft wall 7 on the counter-pressure side exclusively in the region of the second partial wall sections 12, whereas the shaft wall 7 in the region of the fourth partial wall sections 17 undergoes an increase in stability, but merely an improved and more flexible arrangement of the injection nozzle.

For the piston 1 according to FIG. 1, it applies that:

the fourth partial wall sections 17 at the boss connection have a smaller distance from each other than at the shaft connection A<B, the second partial wall sections 12 at the boss connection have a smaller distance from each other than at the shaft connection D<C, a longitudinal centre line 13 at the height of the boss nadir of the first partial wall section 11 is arranged staggered with respect to a longitudinal centre line 14 of the second partial wall section 12, the two longitudinal centre lines 13, 14 of the two partial wall sections 11, 12 intersect each other outside the piston 1.

For the piston 1 according to FIG. 2, it applies that:

the fourth partial wall sections 17 at the boss connection have a greater distance from each other than at the shaft connection A>B, the second partial wall sections 12 at the boss connection have a smaller distance from each other than at the shaft connection D<C, a longitudinal centre line 13 at the height of the boss nadir of the first partial wall section 11 is arranged staggered with respect to a longitudinal centre line 14 of the second partial wall section 12, the two longitudinal centre lines 13, 14 of the two partial wall sections 11, 12 intersect each other outside the piston 1.

For the piston 1 according to FIG. 3, it applies that:

the fourth partial wall sections 17 at the boss connection have a greater distance from each other than at the shaft connection A>B, the second partial wall sections 12 at the boss connection have a greater distance from each other than at the shaft connection D>C, a longitudinal centre line 13 at the height of the boss nadir of the first partial wall section 11 is arranged staggered with respect to a longitudinal centre line 14 of the second partial wall section 12, the two longitudinal centre lines 13, 14 of the two partial wall sections 11, 12 intersect each other outside the piston 1.

The boss nadir is understood here to mean the base point of the pin boss 10, which lies beneath the zenith and the equator of the pin boss 10.

The invention claimed is:

1. A piston for an internal combustion engine comprising: a piston head and a piston shaft adjoining thereon, the piston shaft having two shaft walls, wherein one of the shaft walls is arranged on a pressure side and the other of the shaft walls is arranged on a counter-pressure side, and two box walls connecting the shaft walls, at least one pin boss disposed in each of the box walls, each of the box walls having a first partial wall section and a second partial wall section, the first partial wall section extending between the pin boss and the shaft wall arranged on the pressure side, and the second partial wall section extending between the pin boss and the shaft wall arranged on the counter-pressure side, a first longitudinal centre line of the first partial wall section being convergent to a second longitudinal centre line of the second partial wall section, wherein the first and second longitudinal centre lines intersect each other outside the piston, and wherein the shaft wall arranged on the pressure side is shorter in a peripheral direction of the piston than the shaft wall arranged on the counter-pressure side.

2. The piston according to claim 1, wherein each box wall has a third partial wall section and a fourth partial wall section, each third partial wall section extending between the pin boss and the shaft wall arranged on the pressure side, and each fourth partial wall section extending between the pin boss and the shaft wall arranged on the counter-pressure side, a third longitudinal centre line of each third partial wall section inside the piston intersects with a fourth longitudinal centre line of each fourth partial wall section.

3. The piston according to claim 2, wherein each of the first and second partial wall sections have a greater wall thickness than each of the third and fourth partial wall sections.

4. The piston according to claim 2, wherein a distance between the two box walls decreases as each fourth partial wall section extends inwardly towards the shaft wall arranged at the pressure side.

5. The piston according to claim 2, wherein each of the fourth partial wall sections extends away from each other in the direction of the shaft wall arranged on the counter-pressure side.

6. The piston according to claim 2, wherein each of the respective third and fourth partial wall sections extend towards each other in the direction of the shaft wall arranged on the pressure side and in the direction of the shaft wall arranged on the counter-pressure side.

7. The piston according to claim 2, wherein each third and fourth partial wall section is convex with respect to an orthogonal of the axis of the pin boss.

8. The piston according to claim 2, wherein each of the fourth partial wall sections extend away from each other in the direction of the shaft wall arranged on the counter-pressure side.

9. The piston according to claim 1, wherein each of the first partial wall sections of the two box walls extend towards each other in the direction of the shaft wall arranged on the pressure side.

10. The piston according to claim 1, wherein each of the second partial wall sections of the two box walls extend away from each other in the direction of the shaft wall arranged on the counter-pressure side.

11. The piston according to claim 1, wherein each of the second partial wall sections of the two box walls extend towards each other in the direction of the shaft wall arranged on the counter-pressure side.

12. The piston according to claim 1, wherein each of the second partial wall sections of the two box walls extend parallel to each other.

13. The piston according to claim 1, wherein each of the first partial wall sections of the two box walls extend away from each other in the direction of the shaft wall arranged on the pressure side.

14. A piston for an internal combustion engine comprising:

a piston head and a piston shaft adjoining thereon, the piston shaft having two shaft walls, wherein one of the shaft walls is arranged on a pressure side and the other shaft wall is arranged on a counter-pressure side;

two box walls connecting the shaft walls and at least one pin boss disposed in the box walls;

each of the box walls having a first partial wall section extending between the pin boss and the shaft wall arranged on the pressure side and a second partial wall section extending between the pin boss and the shaft wall arranged on the counter-pressure side, each box wall having a third and a fourth partial wall section, the third partial wall section extending between the pin boss and the shaft wall arranged on the pressure side, and the fourth partial wall section extending between the pin boss and the shaft wall arranged on the counter-pressure side, wherein the fourth partial wall sections have at least one of a smaller distance and a greater distance from each other at the pin boss than at the shaft arranged on the counter-pressure side and the second partial wall sections have at least one of a smaller distance and a greater distance from each other at the pin boss than at the shaft arranged on the counter-pressure side; and a first longitudinal centre line of the first partial wall section being convergent to a second longitudinal centre line of the second partial wall section, the two longitudinal centre lines of the two partial wall sections intersecting each other outside the piston, wherein the shaft wall arranged on the pressure side is shorter in a peripheral direction of the piston than the shaft wall arranged on the counter-pressure side.

15. The piston of claim 14, wherein the fourth partial wall sections have a smaller distance from each other at the pin boss than at the shaft arranged on the counter-pressure side and the second partial wall sections have a smaller distance from each other at the pin boss than at the shaft arranged on the counter-pressure side.

16. The piston of claim 14, wherein the fourth partial wall sections have a greater distance from each other at the pin boss than at the shaft arranged on the counter-pressure side and the second partial wall sections have a smaller distance from each other at the pin boss than at the shaft arranged on the counter-pressure side.

17. The piston of claim 14, wherein the fourth partial wall sections have a greater distance from each other at the pin boss than at the shaft arranged at the counter-pressure side and the second partial wall sections have a greater distance from each other at the pin boss than at the shaft arranged on the counter-pressure side.

18. The piston of claim 17, wherein each of the second partial wall sections of the two box walls extend towards each other in the direction of the shaft wall arranged on the counter-pressure side.

* * * * *